US008959869B2

(12) United States Patent
Kordecki

(10) Patent No.: US 8,959,869 B2
(45) Date of Patent: Feb. 24, 2015

(54) STUD BRACKET FOR TEMPORARY WALL

(75) Inventor: John R. Kordecki, Arlington Heights, IL (US)

(73) Assignee: Stud Jack It Company, Arlington Heights, IL (US)

( * ) Notice: Subject to any disclaimer, the term of this patent is extended or adjusted under 35 U.S.C. 154(b) by 0 days.

(21) Appl. No.: 13/488,041

(22) Filed: Jun. 4, 2012

(65) Prior Publication Data

US 2012/0324821 A1 Dec. 27, 2012

Related U.S. Application Data

(60) Provisional application No. 61/519,998, filed on Jun. 3, 2011, provisional application No. 61/632,139, filed on Jan. 19, 2012.

(51) Int. Cl.

| | |
|---|---|
| ***E04B 1/38*** | (2006.01) |
| ***E04G 21/24*** | (2006.01) |
| ***E04G 25/06*** | (2006.01) |
| *E04B 2/74* | (2006.01) |
| *E04B 2/82* | (2006.01) |

(52) U.S. Cl.

CPC ..... *E04G 21/243* (2013.01); *E04B 2002/7494* (2013.01); *E04B 2002/7496* (2013.01); *E04G 25/066* (2013.01); *E04G 25/065* (2013.01); *E04B 2/821* (2013.01)

USPC ..... 52/708

(58) Field of Classification Search

CPC ..... E04B 2/74; E04B 2/7453; E04B 2/76; E04B 2/767; E04B 2/80; E04B 2/56; E04B 2/58; E04B 2/70; E04B 2/701; E04B 2/703; E04B 2/716; E04B 2002/562; E04B 2002/749; E04B 2002/7492; E04B 2002/7494; E04B 2002/7496; E04C 2/384; E04C 2/32; E04C 2/292; E04C 2003/026

USPC ..... 52/835, 293.3, 698, 289, 702, 707, 708, 52/709, 710, 711, 712, 481.1, 481.2

See application file for complete search history.

(56) References Cited

U.S. PATENT DOCUMENTS

| | | | | | |
|---|---|---|---|---|---|
| 3,537,217 | A * | 11/1970 | Lickliter et al. | ..... | 52/126.4 |
| 3,685,227 | A * | 8/1972 | Grisard et al. | ..... | 52/242 |
| 3,999,353 | A * | 12/1976 | Dielman | ..... | 52/835 |
| 4,103,463 | A * | 8/1978 | Dixon | ..... | 52/126.4 |
| 4,718,628 | A * | 1/1988 | Vitta | ..... | 248/354.3 |
| 5,303,520 | A * | 4/1994 | Gozdziak | ..... | 52/92.2 |
| 6,250,041 | B1 * | 6/2001 | Seccombe | ..... | 52/712 |
| 8,079,188 | B2 * | 12/2011 | Swartz et al. | ..... | 52/281 |
| 8,234,826 | B1 * | 8/2012 | Proffitt, Jr. | ..... | 52/293.3 |

* cited by examiner

*Primary Examiner* — Jessica Laux
(74) *Attorney, Agent, or Firm* — Bishop Diehl & Lee, Ltd.

(57) ABSTRACT

An expandable stud bracket for attachment to a 2×4, 2×6, or 4×4 board for construction of a temporary structure of support is disclosed. An embodiment of the bracket includes a receiving portion for securing the bracket to a stud, an adjustable portion opposite the receiving portion and having an extendable rod, an engagement plate attached to an end of the rod and an anchor attached to an end of the rod opposite the engagement plate and for limiting extension of the rod from the bracket, and a locking mechanism attached to the rod for preventing retraction. Optionally, a detachable foot portion may be used as part of the entire disclosed expansion system. Preferably, the extendable rod is threaded and the locking mechanism comprises a nut which can be tightened using a lever. The bracket may also accommodate angled surfaces.

4 Claims, 12 Drawing Sheets

STUD BRACKET FOR TEMPORARY WALL

RELATED APPLICATIONS

The present application is related to and claims the filing priority of U.S. Provisional Application No. 61/519,998, filed Jun. 3, 2011, and U.S. Provisional Application No. 61/632,139, filed Jan. 19, 2012. The entirety of these provisional applications is hereby incorporated by reference.

TECHNICAL FIELD OF THE INVENTION

The present device and system relate to building materials for erecting temporary walls. Particularly, the present device and system relate to an expandable bracket to facilitate construction of a temporary wall or work-space.

BACKGROUND OF THE INVENTION

In the construction field, the need for installation of temporary walls and studs (vertical and horizontal) often arises. Some of these occurrences are expected and some unexpected. Regardless, erecting these temporary structures can add considerable cost and time to a construction project. The frequency of the need for such structures appears to be on the increase.

For example, as a result of new Federal construction laws, dust control walls are now required under certain circumstances. Specifically, a contractor/remodeler must contain and isolate any area where lead-base paint may be present prior to cutting and removing walls or ceiling material from the structure. This law applies to any home, school, or day care facility built before 1978, where the presence of lead-based paint must be assumed and tested for before work can be performed.

Similarly, some construction projects require the installation of temporary studs. When an existing wall is being prepared to be removed, the ceiling structure above must be temporarily supported. This is commonly accomplished by installing a temporary 2"×4" stud under each ceiling support joist. When done properly, installation of the temporary wall can require as much time and energy as construction of a permanent wall.

The systems that are currently available are designed solely to support the weight of plastic for dust control. These systems are not designed to support the weight that would be required for a temporary support structure. Many of these dust control systems consist of round metal telescoping poles which are designed to hold the plastic at the ceiling. Adhering the plastic to the round pole is cumbersome and expensive when using additional material such as painter's tape. Additionally, the pole system is somewhat expensive to have sufficient supports.

The present invention addresses and solves these and other problems associated with the construction of temporary structures. By providing a device and a system which can be quickly installed, the present invention reduces the time, cost and energy required for construction of temporary structures.

SUMMARY OF THE INVENTION

There is disclosed herein in adjustable stud for the construction of a temporary structure which avoids the disadvantages of prior devices while affording additional structural and operating advantages. The adjustable stud system is reliable, sturdy, and reusable.

In a first embodiment, the expandable stud bracket comprises a receiving portion for securing the bracket to a stud, an adjustable portion opposite the receiving portion and having an extendable rod, an engagement plate attached to an end of the rod and an anchor attached to an end of the rod opposite the engagement plate and for limiting extension of the rod from the bracket, and a locking mechanism attached to the rod for preventing retraction.

Optionally, a detachable foot portion may be used. Preferably, the extendable rod is threaded and the locking mechanism comprises a nut which can be tightened using a lever.

In an alternate embodiment, the bracket includes a detachable extendable plate mechanism and a housing with two ends for receiving boards.

In another alternate embodiment, the bracket includes a pair of complementary wedges which allow support of an angled surface.

Further, a stud expansion system is disclosed comprising a housing having a plurality of sidewalls, a first open end, a second open end and an opening defined in a sidewall for accessing the interior of the housing, an extendable plate mechanism comprising an anchor plate, an extension tube fixed to the anchor plate, an extension rod movable within the extension tube, and an engagement plate fixed to an end of the extension rod, and a locking mechanism for securing the extension rod at a desired extended length.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
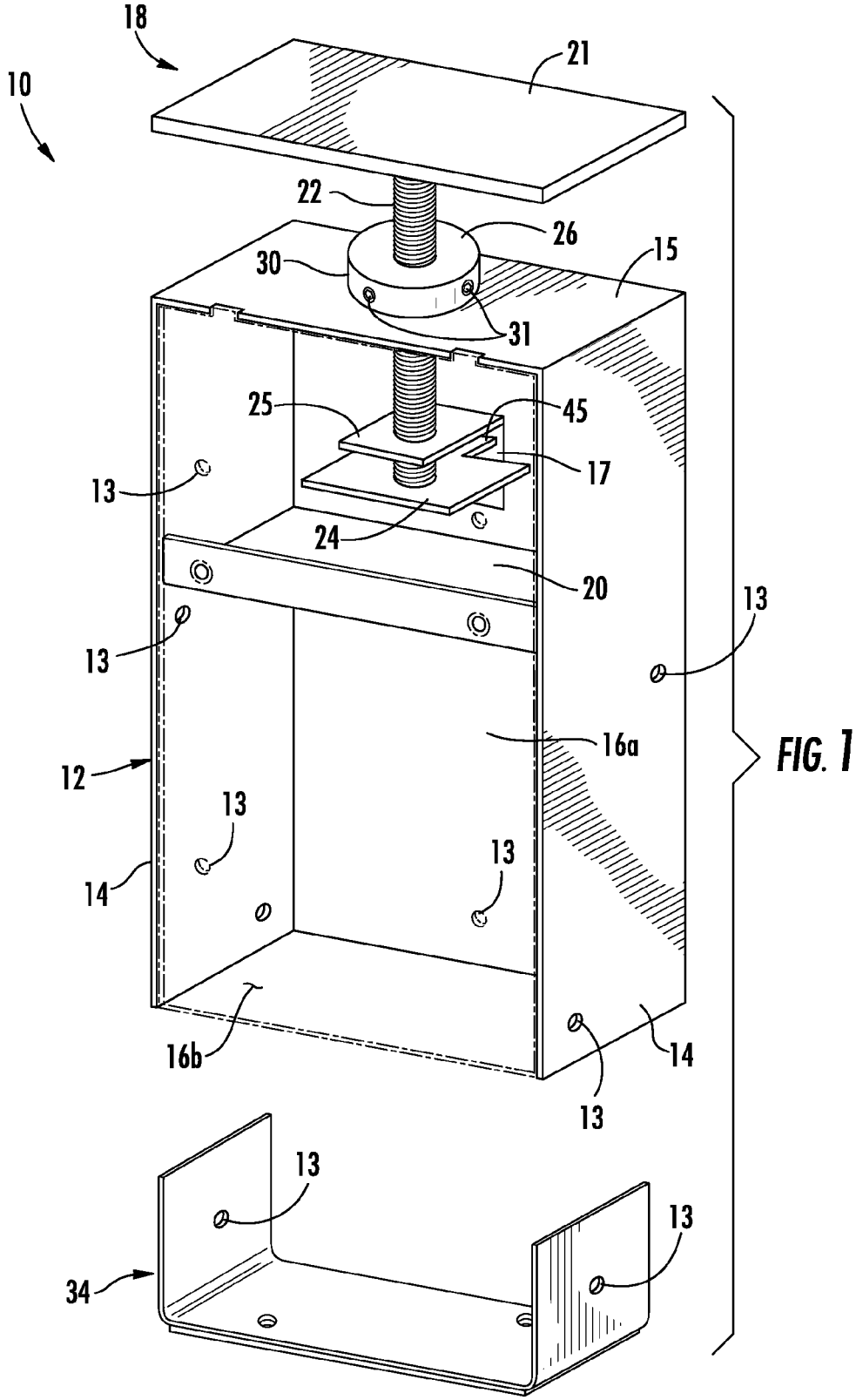
FIG. 1 is a perspective view of an embodiment of the present bracket system.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

Referring to FIGS. 1-11, there is illustrated several embodiments of an expandable bracket, generally designated by the numeral 10. Additional embodiments and related components are similarly designated with the addition of a 1, 2, 3, . . . etc. to distinguish between such embodiments. The bracket 10 can be designed for attachment to an end of a 2"×4", 4"×4", or 2"×6" board, then the assembly is placed between two stationary surfaces, e.g., floor-to-ceiling, wall-to-wall, and expanded. The assembly may be used both horizontally and vertically with equal success and is not limited to the few examples described and illustrated herein.

In the embodiment illustrated in FIGS. 1-6, the bracket 10 includes a housing 12 comprised of sidewalls 14, a top panel 15, and front and back panels 16*a-b*, and an expansion mechanism 18 (Note: the back panel 16*b* is shown in broken lines in FIG. 1 to allow better viewing of the bracket interior). The bottom of the housing 12 is left open for receiving the end of a board. Holes 13 defined within the sidewalls, and top, front and back panels allow nails and/or screws (not shown) to retain the board within the open end of the bracket 10. An internal stop 20 is used to halt the insertion of the board so as not to interfere with the operation of the expansion mechanism 18. Window 11 (FIG. 2) is preferably defined within the front panel 16*a* to allow the user to visually ascertain when a board is inserted sufficiently to contact stop 20.

Figure 3:
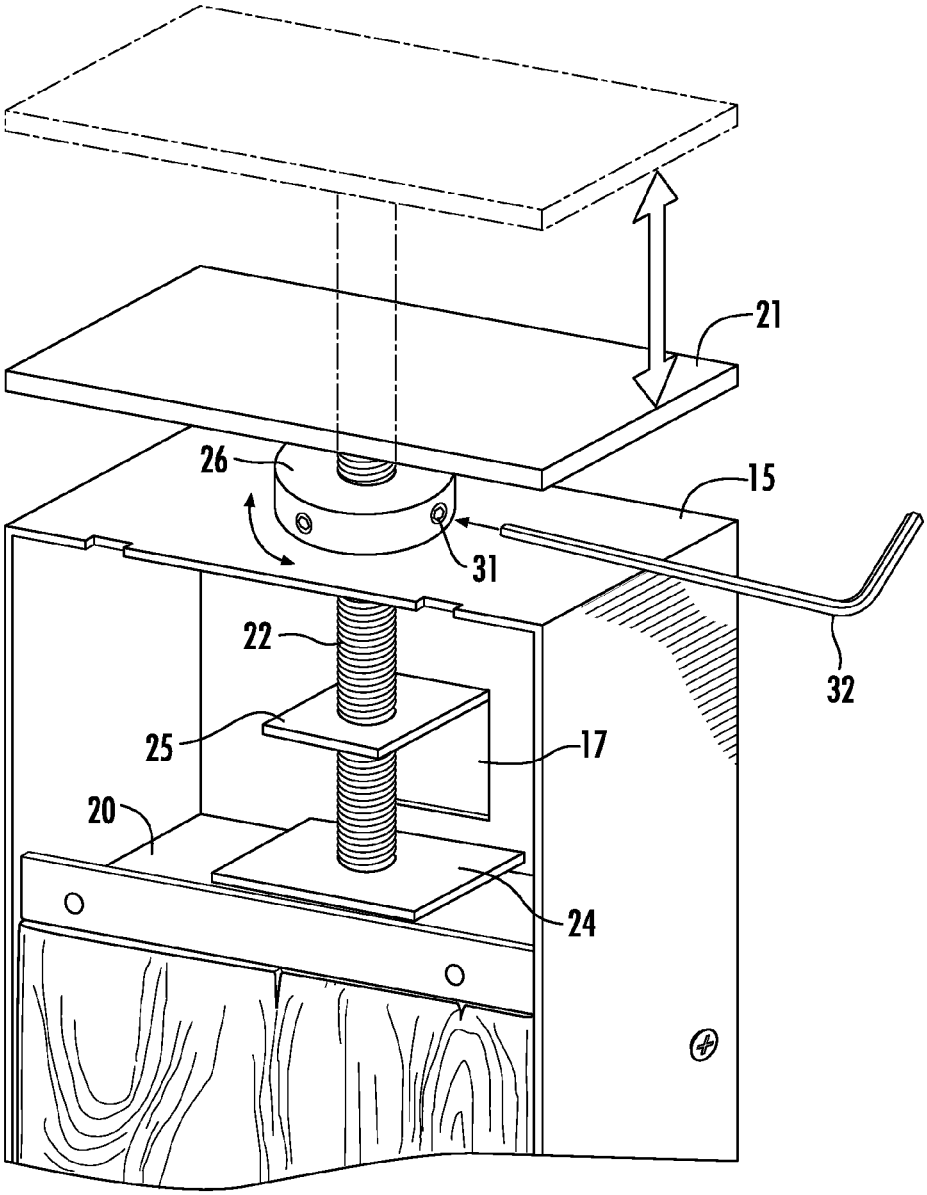
FIG. 3 is a close up perspective view illustrating the movement of an embodiment of the engagement plate of a bracket.
Figure 4A:
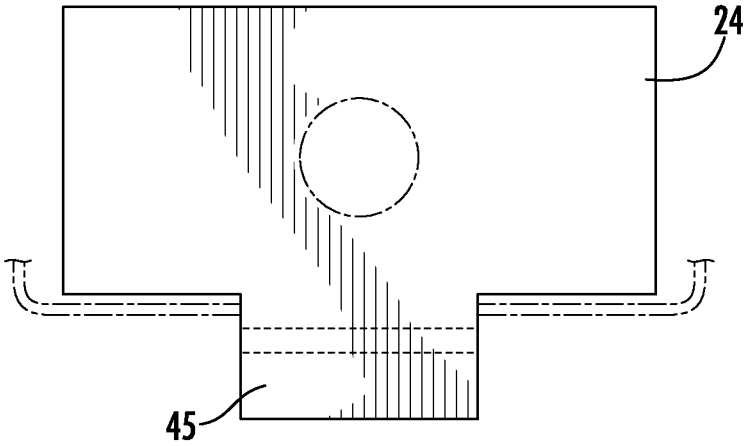
FIGS. 4*a* and 4*b* are views of a safety feature and thumb lift used in embodiments of the present invention.
Figure 4B:
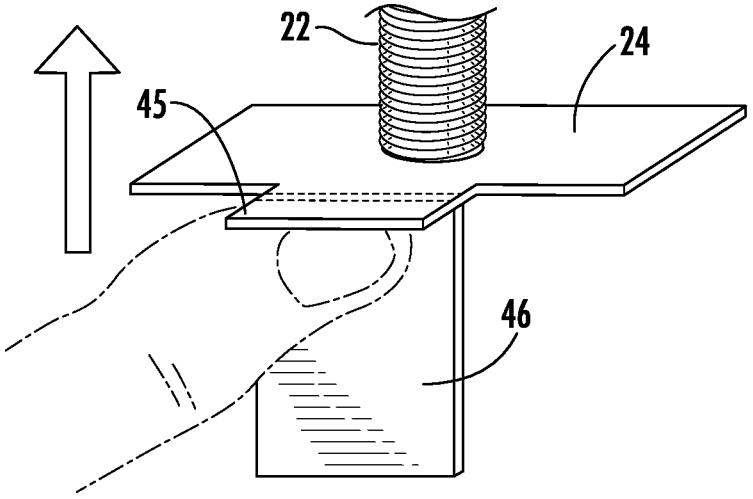
Figure 6:
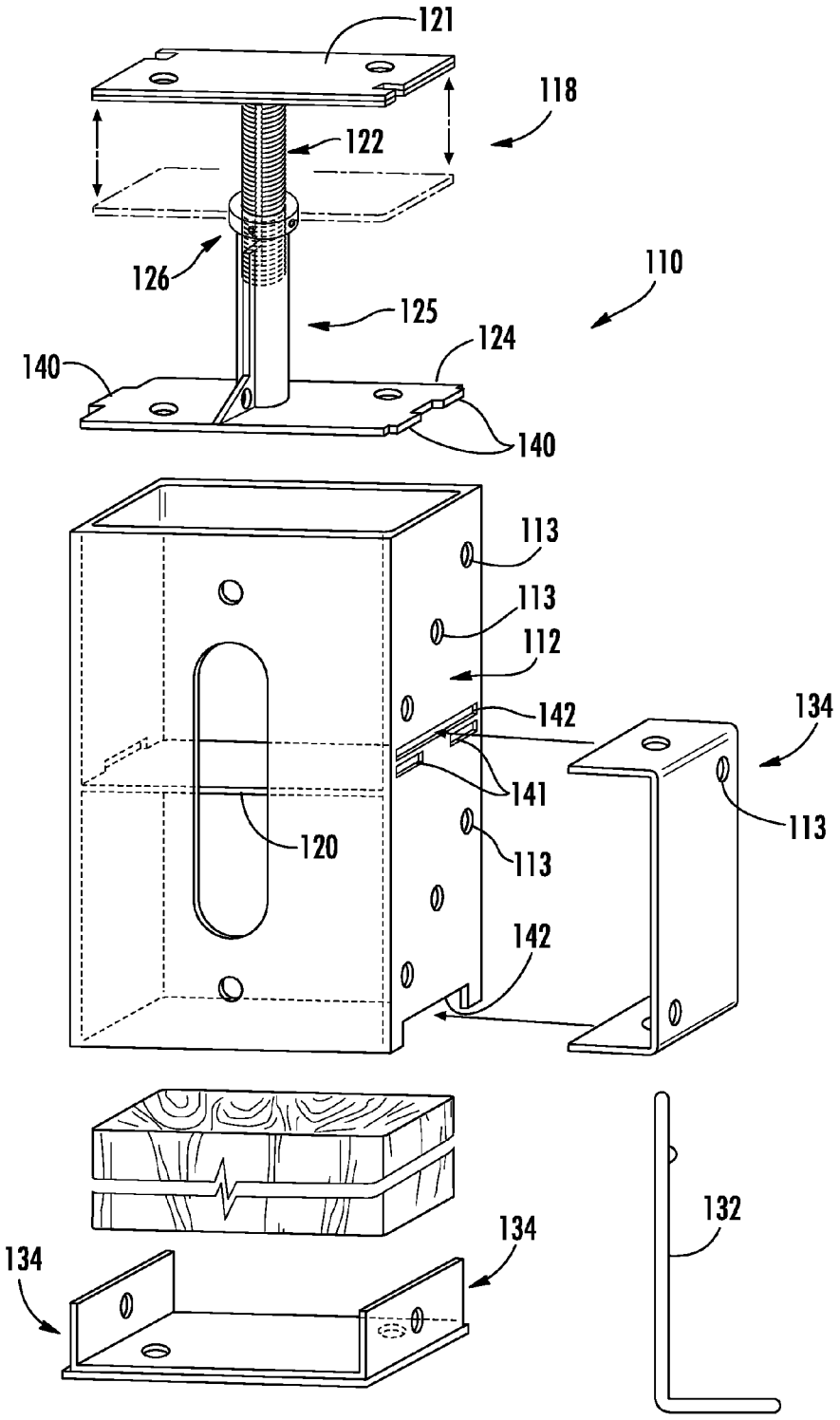
FIG. 6 is an exploded perspective view of another embodiment of a bracket system.

Referring to FIG. 3, the expansion mechanism 18 is positioned at the top of the bracket 10 and includes an engagement plate 21, an extension rod, and an anchor 24. The engagement plate 21 is preferably fixed, via a weld or other means, to one end of the extension rod 22, while the anchor 24 is likewise fixed to the other end of the rod 22. In various of the disclosed embodiments, the engagement plate 21 and/or the anchor 24 may include holes for securing to a surface via nails or screws. FIG. 6 illustrates edge slots on engagement plate 21 for "toe-nailing" to a surface.

An opening in the top panel 15 and a guide 25 positioned within the housing 12, retain the extension rod 22 in a position to move only in a direction perpendicular to the top panel 15. The guide 25 is preferably provided by cutting three sides of a rectangular section of the front panel 16*a* and bending it into the housing interior, leaving an opening 17 on the front panel 16*a* of housing 12. The guide 25, which is completed with a hole therein to retain the extension rod 22, also provides a limit to the upward movement of the rod 22 by stopping the anchor 24 from further travel. The rod 22 otherwise moves freely within the holes of the top panel 15 and guide 25.

Preferably, the expansion mechanism 18 provides about 0.5 inches to about 6 inches of adjustability. Most preferably, the adjustability is limited to a range of from about 0.75 inches to about 2.0 inches. In a preferred embodiment, shown in FIGS. 4*a-b*, the expansion mechanism 18 is extended manually through opening 17 in front panel 16*a*. The anchor 24 is provided with a tab 45 which extends through the opening 17 and a protective cover 46 which prevents the user from placing anything, especially fingers, under the anchor 24. As the anchor 24 is raised via tab 45, the protective cover 46 blocks the opening 17. This is not only an important safety feature for the illustrated embodiment, but a useful feature for more readily extending the engagement plate 21. The tab 45 allows a user to use one hand to raise and hold the plate 21 in place, while adjusting locking mechanism 26 with the other hand.

Figure 2:
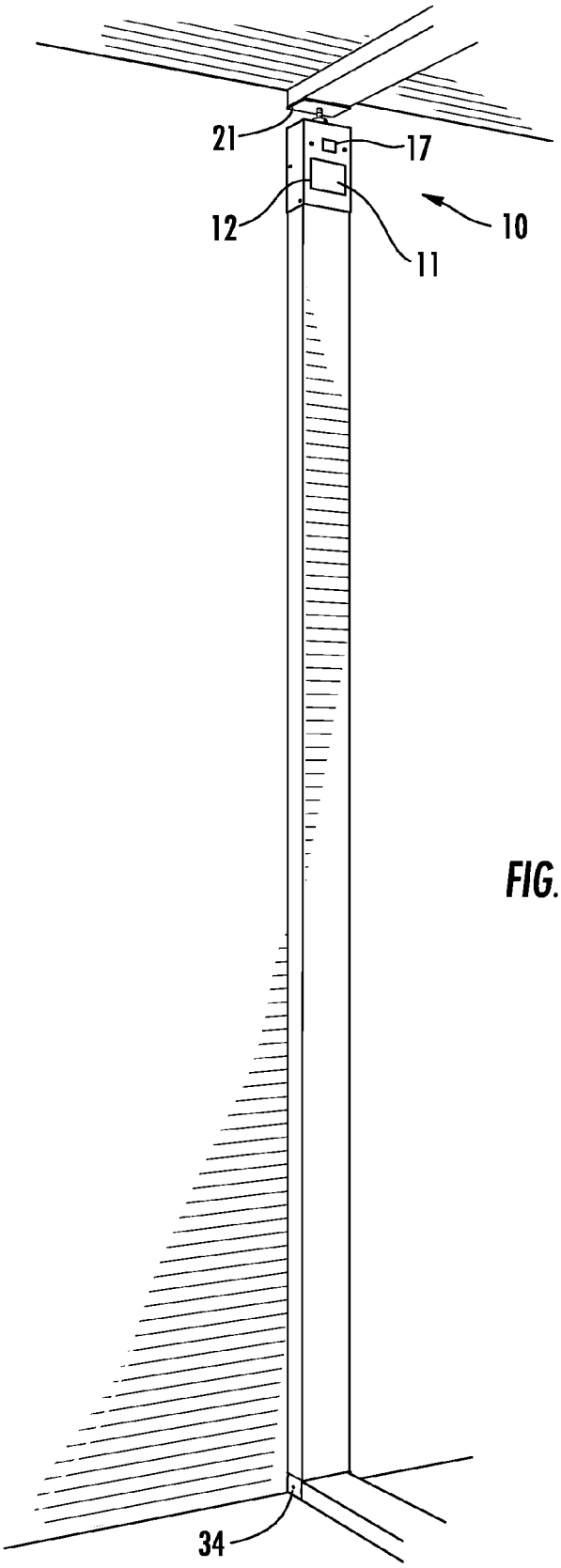
FIG. 2 is a perspective view of the embodiment of FIG. 1 in use.

Also shown in FIGS. 1-3 is locking mechanism 26 attached to the rod 22 to lock the downward travel of the rod 22, and thus the engagement plate 21. For ease of access and structural integrity, the locking mechanism 26 is positioned outside the bracket housing 12 to abut the top panel 15 in use. However, it may be alternately positioned within the housing 12 to abut the guide 25 or another surface. In the illustrated embodiment, the rod 22 is a threaded rod and the locking mechanism 26 is a knurled finger nut 30 threaded onto the rod 22.

The nut 30 is also preferably provided with lever slots 31 to facilitate tightening of the locking mechanism 26. The slots 31 are merely round openings into which a tool may be inserted for added leverage to torque nut 30 to be either tightened or loosened on rod 22. Specifically for this purpose, a lever 32 may be provided as part of a stud expansion system. The lever 32 is preferably metal and round (in cross-section) with a length sufficient to allow turning of the nut 30 without impacting the user's hands (e.g., knuckles) on the housing 12 edges. The lever 32 may also be stored on or within the housing 12 using by adding a slot (not shown) or magnets (not shown).

As an optional feature of the bracket system 10, a detachable foot 34 may be provided. The foot 34 is preferably a U-shaped device having nail/screw holes defined therein. A rubber pad 35 may also be provided on a contacting surface of the foot 34. The foot 34 may be used in one of two ways.

Figure 5A:
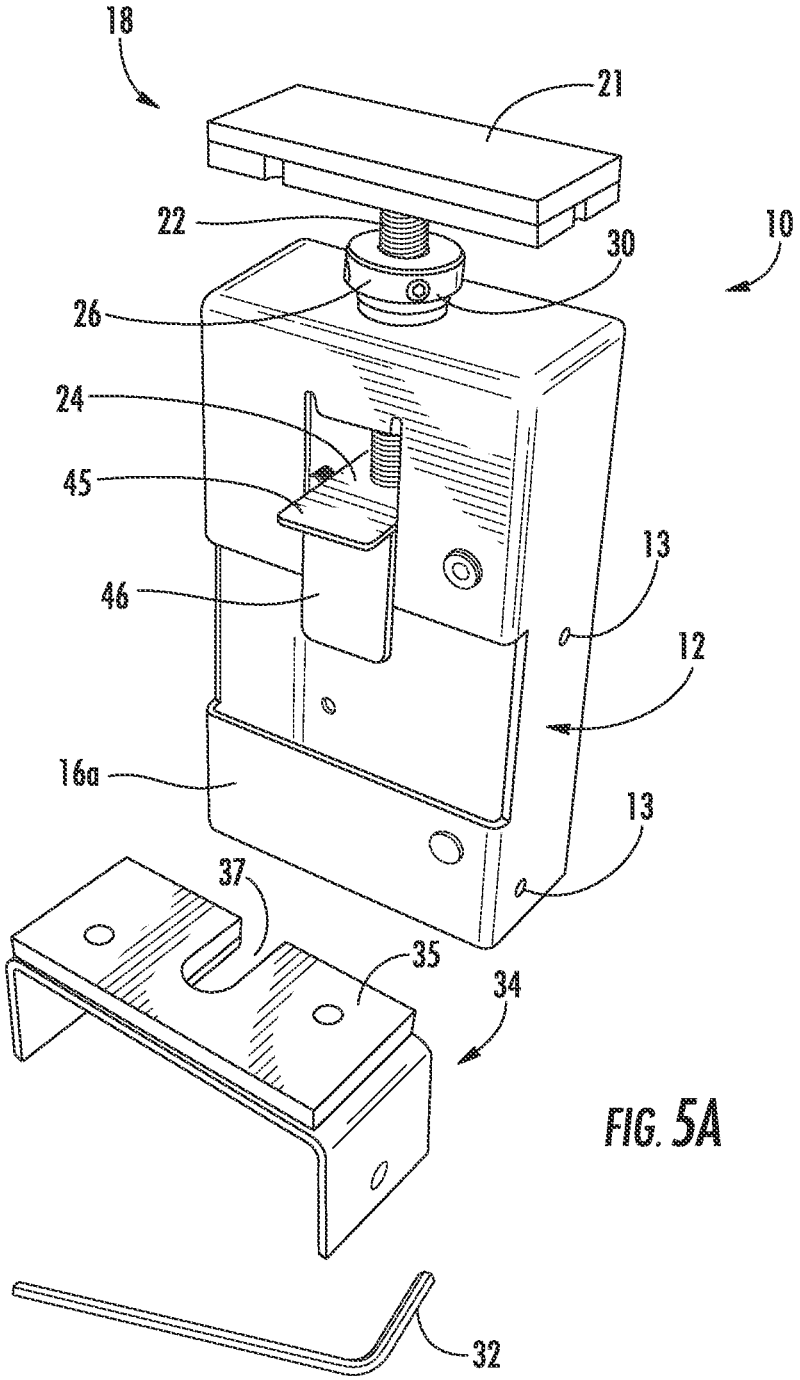
FIG. 5 is a perspective view of an embodiment of the bracket system illustrating storage of a foot portion.
Figure 5B:
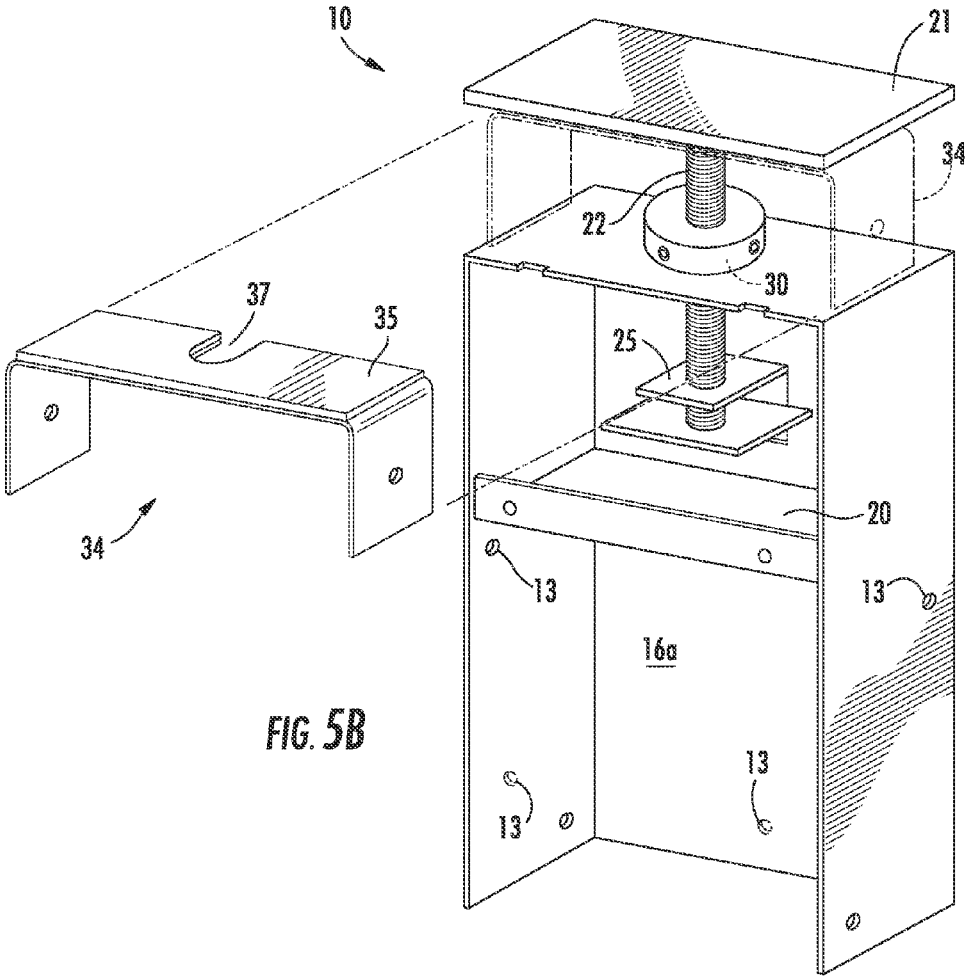

The foot 34 may be secured to an opposite end of a board within the bracket 10. This allows the padded side of the foot 34 to contact other surfaces without marring, scratching or moving. Alternatively, the foot 34 may be inverted and secured by nail/screw to the opposite end of the board within the bracket 10, via the padded surface, and also secured by nail/screw to a perpendicular board via the arms of the foot 34. The latter configuration is preferably used whenever the support board is being attached to a perpendicular board. A notch 37 may optionally be provided in the foot 34, as shown in FIG. 5, to allow storage during non-use.

In use, with reference to FIG. 2, an end of a board of the proper dimensions is first secured within the receiving end of the bracket 10 using the defined sidewall holes and nails or screws. Similarly, the foot 34 may be optionally attached to the opposite end of the board, as described above. The expansion mechanism 18 is then manually extended to a distance just less than the span in which the temporary stud is to be placed. This is done by extending out the engagement plate 21 by lifting the anchor 24. The nut 30 is then easily spun to engage the top panel 15 of housing 12.

The assembly can then be positioned properly in the desired space and the lever 32 can be inserted into a slot 31 and used to turn the locking mechanism 26 to thereby further extend the extension rod 22 and engagement plate 21 until sufficient support is achieved. At all times while turning the locking mechanism 26/nut 30, the anchor 24 prevents turning of the threaded rod by contacting the housing 12.

If necessary, to remove or reposition the temporary stud assembly, the lever 32 may be inserted into a slot 31 and used to turn the locking mechanism 26 in an opposite direction until contact between the engagement plate 21 and opposing surface is lost. The assembly may then be repositioned and retightened or disassembled and stored.

Figure 7:
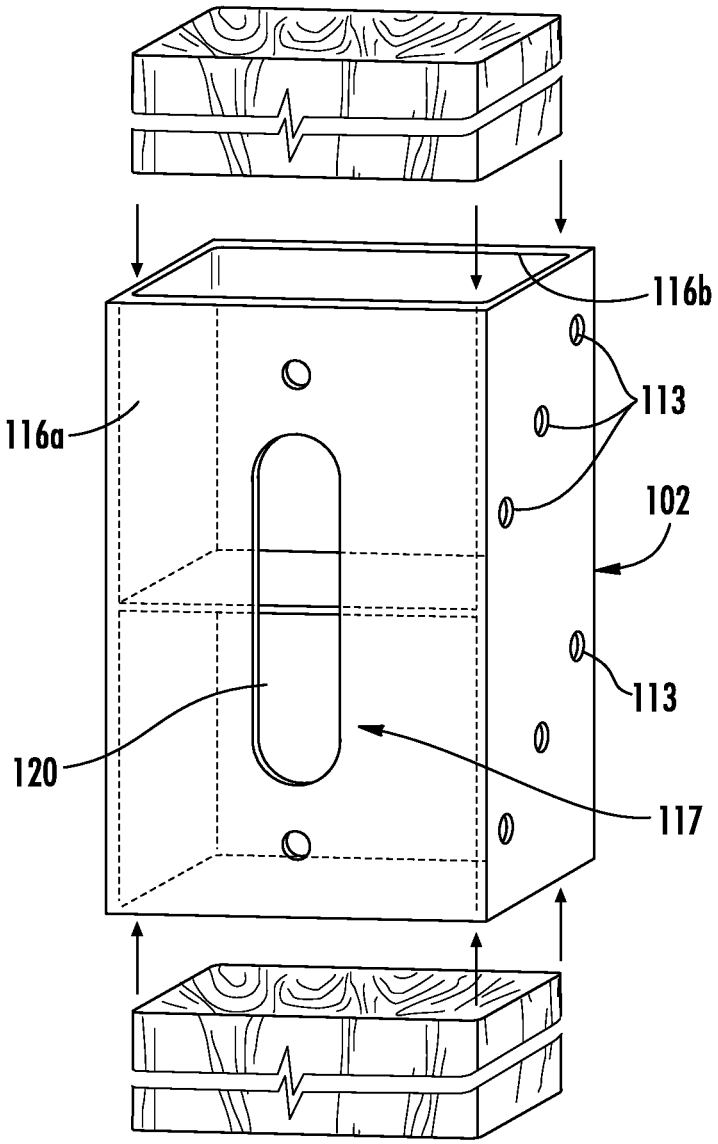
FIG. 7 is a perspective view of an embodiment of a stud sleeve for receiving and retaining two studs.
Figure 8:
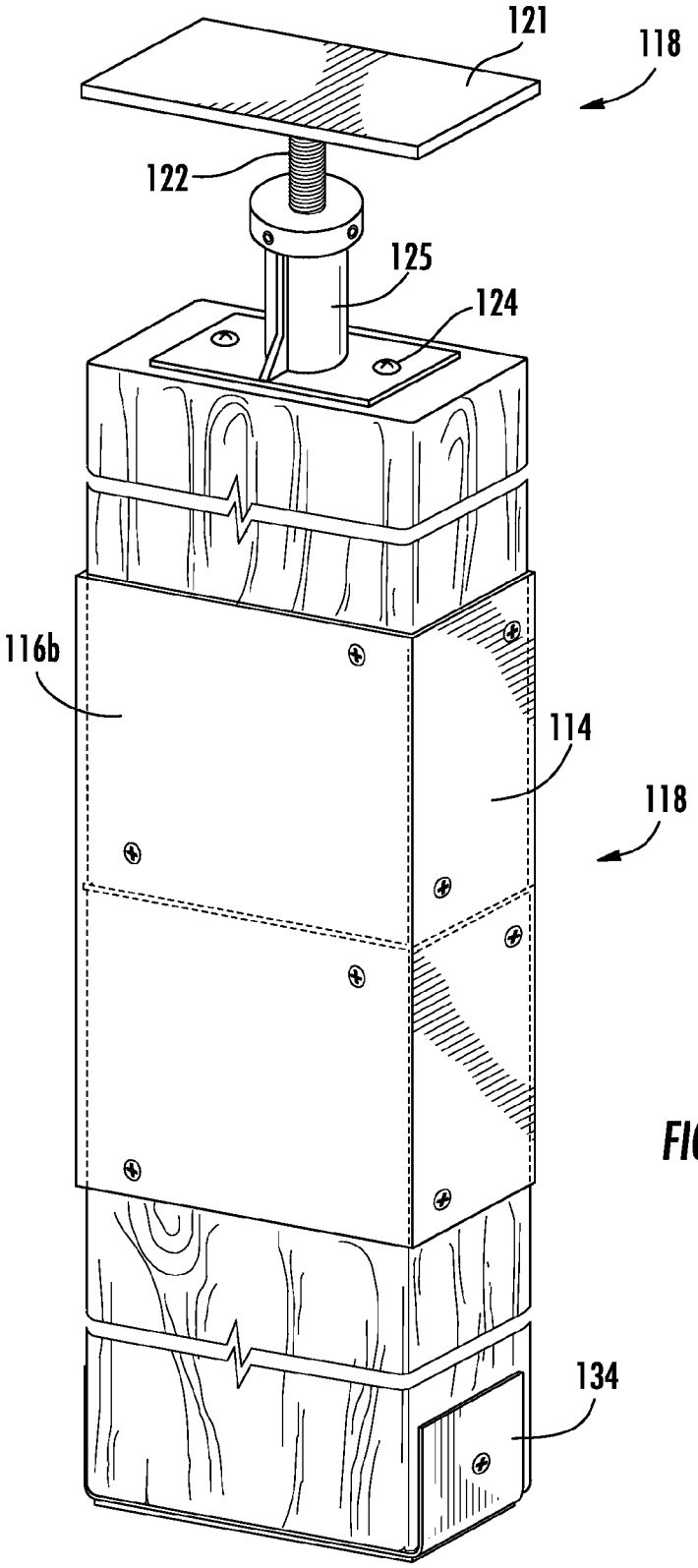
FIG. 8 is a perspective view of another embodiment of a bracket system.

Referring to FIGS. 6-8, several features of alternate embodiments of the present invention, bracket system 110, are illustrated. In these embodiment, the housing 112 is open on both ends to receive a board in one end and the expansion mechanism 118 in the other. Here the expansion mechanism 118 is manufactured as a separate component from the housing 112 and attaches to the housing 112 via tabs 140 inserted within slots 141. This configuration may be best utilized where a less expensive plastic molded housing 118 is used, for example.

Similar to previous embodiments, the expansion mechanism 118 of FIG. 6 comprises an engagement plate 121, an expansion rod 122, and an anchor plate 124, but also includes an expansion tube 125 fixed to the anchor plate 124. The attachable expansion mechanism 118 may be positioned within the housing 112 by snap-fitting the tabs 140 within slots 141, where they may not be removed without destroying housing 112. The anchor plate 124 rests on stop 120 for further support. As with the previous embodiment described above, the rod 122 may be manually extended and the locking mechanism 126 tightened to prevent inward movement of the rod 22. The expansion tube 125 is preferably keyed to the expansion rod 122 or otherwise configured to prevent turning of the expansion rod 122 when engaging locking mechanism 126.

Alternatively, the tube 125 may include internal threads to engage the threaded expansion rod 122. The engagement plate 121 and rod 122 would require turning to extend the mechanism to a desired length. No locking mechanism would be required.

In either configuration, the anchor plate 124 includes holes therein for insertion of nails or screws for attachment to a board inserted in the opposite end of housing 112. As shown in FIG. 8, a possible alternate use for the illustrated embodiment may include attachment of the mechanism 118 to a board end and insertion of boards into both ends of the housing 112.

Optionally, a detachable foot 134 may also be provided. By providing storage slots 142 on housing 112, the arms of foot 134 may be inserted into the slots 142 for storage of the foot during non-use. Magnets fixed to the bracket housing 112 may be used to provide a more positive retention of the stored metal foot 134.

In use, the bracket system 110 of FIG. 8 may allow a greater span for installation by using a board inserted at both ends of the housing 112. The expansion mechanism 118 attaches by the anchor plate 124 to a free end of one of the boards, while the optional foot attaches to a free end of the other board. The expansion mechanism 118 is extended to a distance slightly less than the necessary distance and then positioned where needed. The engagement plate 121 can then be further extended to contact and sufficiently support the opposing surface by either turning the locking mechanism 126 or the engagement plate 121, as required.

FIG. 7 illustrates a sleeve 102 which provides a user with the ability of using, for example, two 4 ft boards (or some variation of two boards measuring 8 ft total) instead of one 8 ft board. Window 117 provides visual assurance of the two boards proper seating in sleeve 102. Either of the free ends of the two boards may then be used with the bracket system 10/110 as described above.

Figure 9:
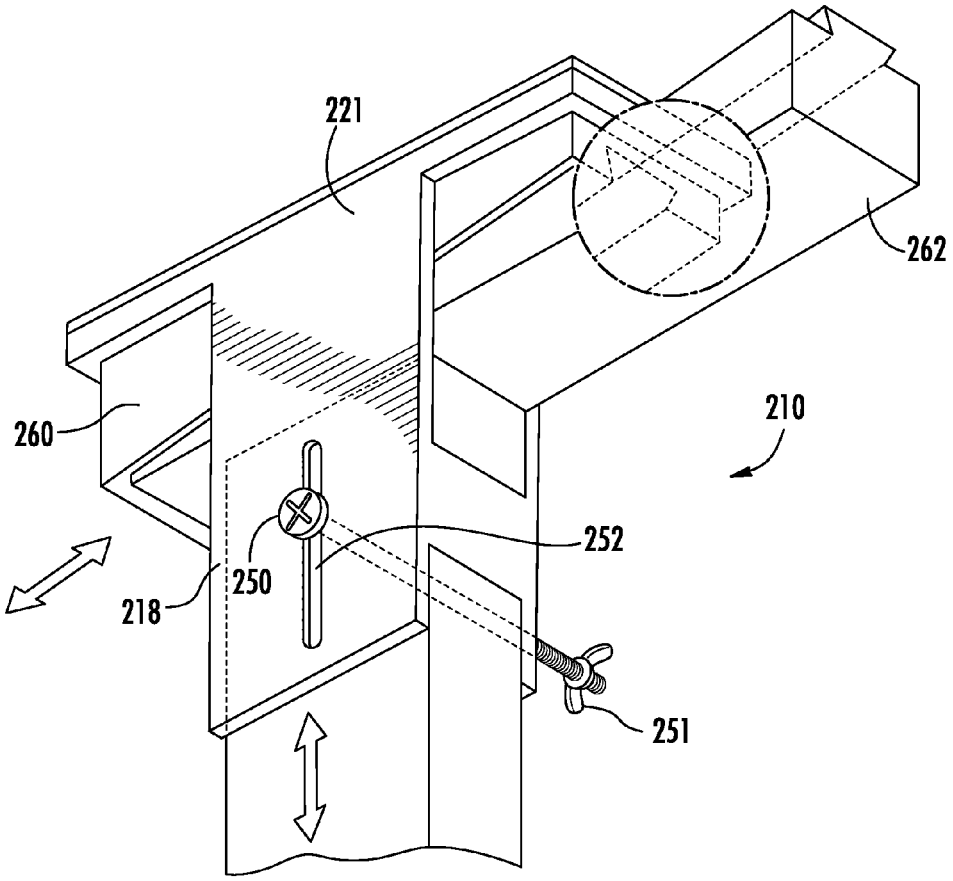
FIG. 9 is a perspective view of another embodiment of a bracket system useful for angled surfaces.
Figure 10:
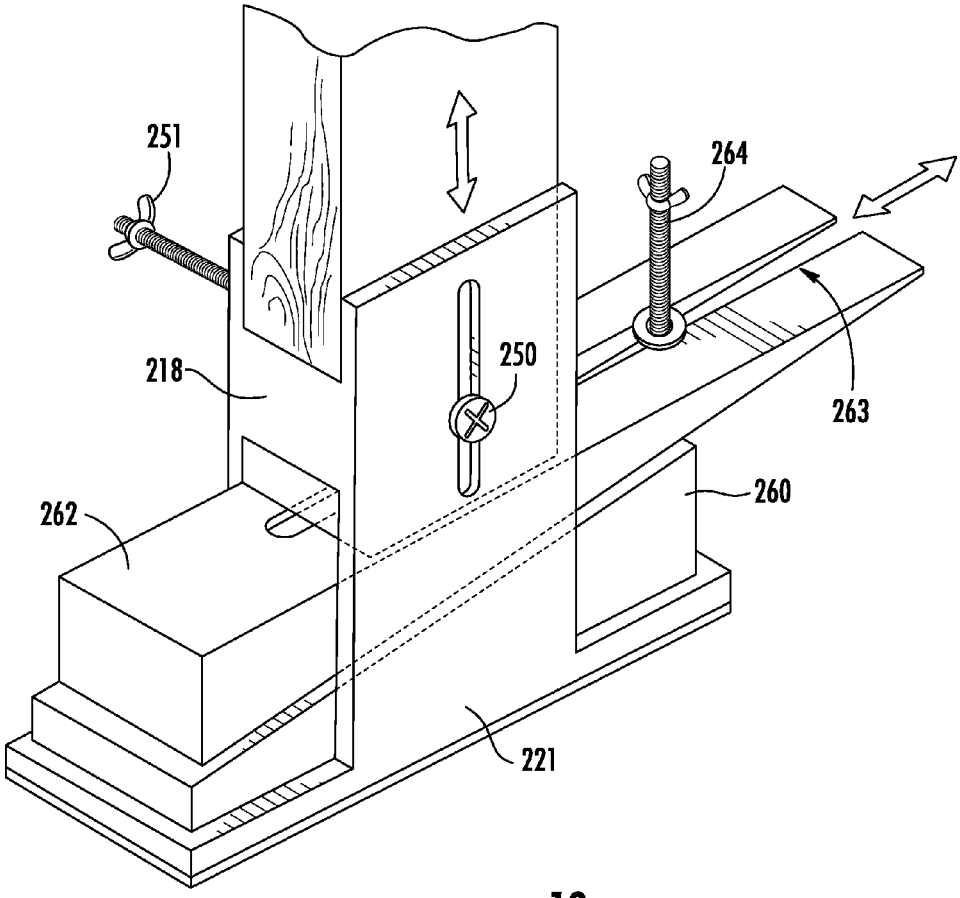
FIG. 10 is a perspective view of another embodiment of a bracket system similar to that shown in FIG. 9.
Figure 11:
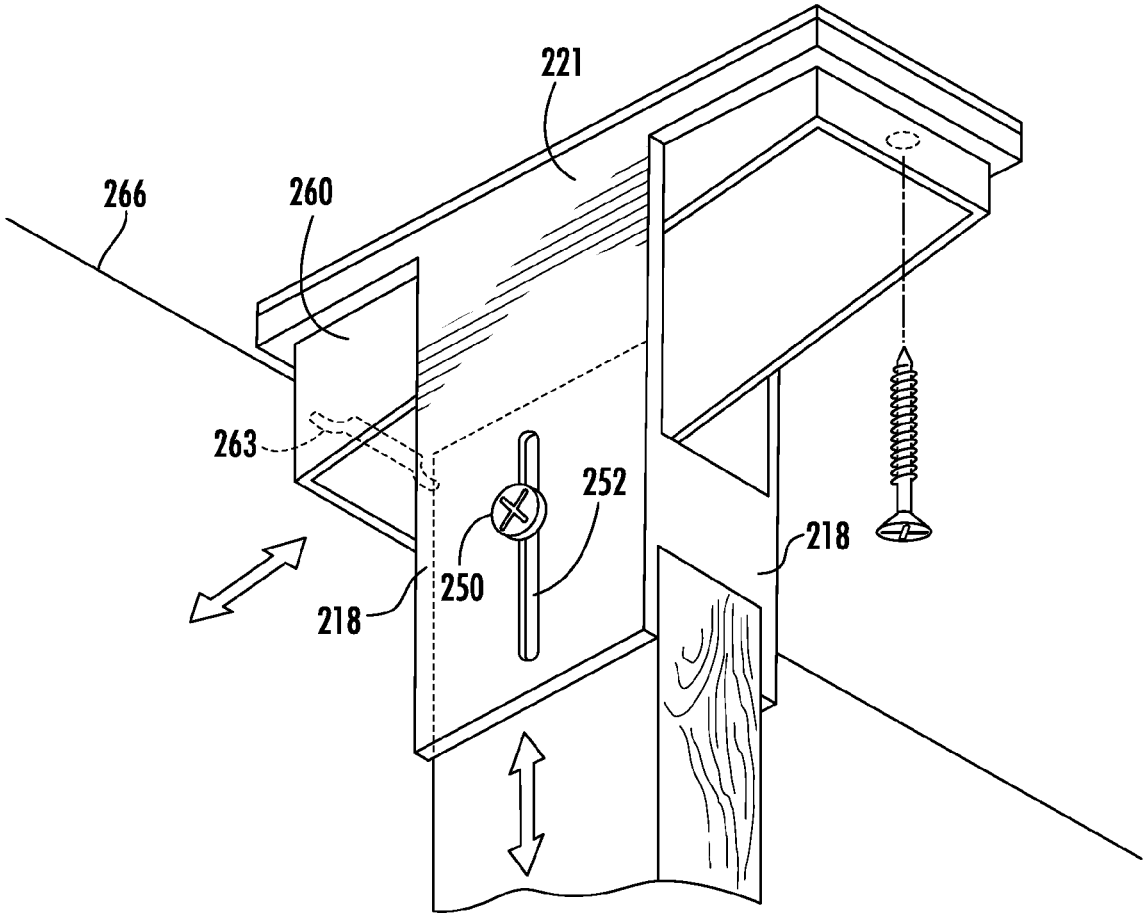
FIG. 11 is a perspective view of the embodiment of FIG. 9 attached to an angled surface.

FIGS. 9-11 illustrate still another embodiment of the invention, bracket system 210. This bracket 210 is suitable for use on flat and sloped surfaces, such as a vaulted ceiling. The bracket 210 is comprised of housing 212 and base 221. The housing 212 includes a receiving end for attachment to a board via bolt 250 and wing nut 251 positioned within slot 232. The slot 232 allows the attached board to move a distance and pivot within the housing 12. The base 221 includes complementary wedges, specifically stationary wedge portion 260 having an approximately 45° surface and a movable wedge portion 262 also having an approximately 45° surface—the individual angles may vary, so long as the resulting combined angle of the two wedges is at least 90°. The movable wedge 262 is configured to slide along the stationary wedge 260 to adjust the angle of the secured board relative the base 221. A dovetail connector is illustrated in FIG. 9, while a channel 263 and bolt 264 connection is shown in FIG. 10. Numerous alternate connection configurations are possible.

In use, a board is inserted into the open end of housing 12 and secured with bolt 250 and wing nut 251—a hole may need to be drilled first. The assembly is positioned where needed with the base surface 221 facing the surface to be supported. The position of board in housing 12 may be adjusted by loosening and retightening the bolt 250 and wing nut 251. The movable wedge 262 can then we slid between stationary wedge 260 and the end of the board until a desired angle within the range of from about 10 to about 90 degrees is achieved. As shown in FIG. 11, the base 221 may include a screw hole for securing the base 221 to the surface before setting the bolt 250 and wing nut 251.

FIG. 11 illustrates a double-hook 263 attached to the base 221. Where a plurality of supports need to be constructed, a string line 266 may be run between two brackets 210, as is known in the art, to align a series of bases 221. As previously described, the bases 221 may be attached via the screw hole before insertion of a board.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. Specifically, several of the disclosed features of the present invention are described and illustrated with some embodiments and not others. Such examples are intended to be descriptive of the features and not limiting of the possible embodiments. It should be understood that all the disclosed features may be provided in any of the described embodiments, as desired. The actual scope of the protection sought is intended to be defined in the following claims when viewed in their proper perspective based on the prior art.

What is claimed is:

1. An expandable stud bracket comprising:

a first engagement portion for securing the bracket to a first end of a stud, the first engagement portion comprising a sleeve having an open end defined by a plurality of sidewalls into which the stud can be seated and the sidewalls having apertures therein for permitting insertion of fasteners into a seated stud;

a second engagement portion for engaging a surface to be supported by the stud, the second engagement portion comprising a plate perpendicular to the seated stud;

an expansion mechanism linking the first engagement portion and the second engagement portion, the expansion mechanism comprising:

an extendable threaded rod fixed at one end to the second engagement portion and passing through at least a first guide opening and into the first engagement portion, the threaded rod being configured to move the second engagement portion relative to the first engagement portion, wherein the threaded rod is configured to be manually manipulated to extend the plate of the second engagement portion away from the first engagement portion to exert a sufficient force onto a surface to be supported;

a manually operated threaded rod lifting mechanism attached to the extendable threaded rod;

an anchor fixed to an end of the extendable threaded rod opposite the second engagement portion and for limiting extending movement of the threaded rod away from the first engagement portion by contacting one of either a second guide opening positioned within the first engagement portion and the first guide opening; and a threaded locking mechanism attached to the threaded rod exterior to the first engagement portion, the threaded locking mechanism being configured to prevent retracting movement of the threaded rod into the first engagement portion, wherein the threaded locking mechanism comprises apertures in an outer surface to allow manual turning of the mechanism with a lever.

2. The expandable bracket of claim 1, further comprising a detachable foot portion configured to attach to a second end of the stud in use and attach to the bracket when not in use.

3. The expandable bracket of claim 1, further comprising a lever for insertion into the apertures of the locking mechanism.

4. The expandable bracket of claim 1, wherein the manual threaded rod lifting mechanism comprises a flange extending from the anchor through a sidewall of the sleeve.

* * * * *